United States Patent [19]

Shekleton et al.

[11] Patent Number: 4,891,936

[45] Date of Patent: Jan. 9, 1990

[54] TURBINE COMBUSTOR WITH TANGENTIAL FUEL INJECTION AND BENDER JETS

[75] Inventors: Jack R. Shekleton; Richard T. LeCren, both of San Diego, Calif.

[73] Assignee: Sundstrand Corporation, Rockford, Ill.

[21] Appl. No.: 138,343

[22] Filed: Dec. 28, 1987

[51] Int. Cl.[4] ..... F23R 3/12; F23R 3/54

[52] U.S. Cl. ..... 60/39.36; 60/746; 60/748; 60/755; 60/760

[58] Field of Search ..... 60/39.36, 746, 743, 60/748, 755, 756, 757, 758, 759, 760

[56] References Cited

U.S. PATENT DOCUMENTS

| | | | |
|---|---|---|---|
| 2,489,683 | 11/1949 | Stalker . | |
| 2,687,010 | 8/1954 | Ellis . | |
| 2,777,407 | 9/1952 | Schindler . | |
| 2,808,012 | 10/1957 | Schindler . | |
| 2,828,608 | 4/1958 | Cowlin et al. . | |
| 2,930,194 | 3/1960 | Perkins | 60/748 |
| 3,238,718 | 3/1966 | Hill . | |
| 3,613,360 | 10/1971 | Howes | 60/39.36 |
| 3,738,105 | 6/1973 | Buchelt . | |
| 3,872,664 | 3/1975 | Lohmann et al. | 60/746 |
| 3,937,008 | 2/1976 | Markowski et al. . | |
| 4,018,043 | 4/1977 | Clemmens . | |
| 4,058,977 | 11/1977 | Markowski et al. | 60/746 |
| 4,186,554 | 2/1980 | Possell . | |
| 4,211,073 | 7/1980 | Guillot | 60/746 |
| 4,404,806 | 9/1983 | Bell et al. | 60/746 |
| 4,689,961 | 9/1987 | Stratton | 60/746 |

*Primary Examiner*—Donald E. Stout

*Attorney, Agent, or Firm*—Wood, Dalton, Phillips, Mason & Rowe

[57] ABSTRACT

The cost of fuel injection nozzles 50 and their tendency to clog in a gas turbine having an annular combustor 26 can be reduced by alternating the fuel injection nozzles 50 with bender jets 56 configured to introduce a combustion supporting gas into an annular combustion zone 40 at locations between the fuel injectors 50 to achieve uniform turbine inlet temperature distribution while requiring fewer of the nozzles 50 and allowing those nozzles 50 that are utilized to have larger fluid flow paths that are less prone to clogging.

9 Claims, 2 Drawing Sheets

TURBINE COMBUSTOR WITH TANGENTIAL FUEL INJECTION AND BENDER JETS

FIELD OF THE INVENTION

This invention relates to gas turbines, and more particularly, to an improved combustor for use in gas turbines.

BACKGROUND OF THE INVENTION

It has long been known that achieving uniform circumferential turbine inlet temperature distribution in gas turbines is highly desirable. Uniform distribution minimizes hot spots and cold spots to maximize efficiency of operation as well as prolongs the life of those parts of the turbine exposed to hot gasses.

To achieve uniform turbine inlet temperature distribution in gas turbines having annular combustors, one has had to provide a large number of fuel injectors to assure that the fuel is uniformly distributed in the combustion air. Fuel injectors are quite expensive with the consequence that the use of a large number of them is not economically satisfactory. Moreover, as the number of fuel injectors increases in a system, with unchanged fuel consumption, the flow area for fuel in each injector becomes smaller. As the fuel flow passages become progressively smaller, the injectors are more prone to clogging due to very small contaminants in the fuel.

This in turn creates the very problem sought to be done away with through the use of a number of fuel injectors. In particular, a fouled fuel injector will result in a non uniform turbine inlet temperature in an annular combustor with the result that hot and cold spots occur.

To avoid this difficulty, the prior art has suggested that by and large axial injection using a plurality of injectors be modified to the extent that such injectors inject the fuel into the annular combustion chamber with some sort of tangential component. The resulting swirl of fuel and combustion supporting gas provides a much more uniform mix of fuel with the air to provide a more uniform burn and thus achieve more circumferential uniformity in the turbine inlet temperature. However, this solution deals only with minimizing the presence of hot and/or cold spots when one or more injectors plug and does not deal with the desirability of eliminating a number of fuel injectors to reduce cost and/or avoiding the use of injectors having very small fuel flow passages which are prone to clogging.

The present invention is directed to overcoming one or more of the above problems.

SUMMARY OF THE INVENTION

It is the principal object of the invention to provide a new and improved annular combustor for a gas turbine. More specifically, it is an object of the invention to provide such a combustor wherein the number of fuel injectors may be minimized and yet uniform circumferential turbine inlet temperature distribution retained along with a minimization of the possibility of the fuel injectors plugging.

An exemplary embodiment of the invention achieves the foregoing objects in a gas turbine including a rotor having compressor blades and turbine blades. An inlet is located adjacent one side of the compressor blades and a diffuser is located adjacent the other side of the compressor blades. A nozzle is disposed adjacent the turbine blades for directing hot gasses at the turbine blades to cause rotation of the rotor and an annular combustor is disposed about the rotor and has an outlet connected to the nozzle and a primary combustion annulus remote from the outlet. A plurality of fuel injectors to the primary combustion annulus are provided and are substantially equally angular spaced about the same. They are configured to inject fuel into the primary combustion annulus in a nominally tangential direction. At least an equal number of combustion supporting air jets are located about the primary combustion annulus in alternating relation with the fuel injectors. The jets are configured to introduce a combustion supporting air into the primary combustion annulus in a nominally tangential direction. Thus, combustion supporting air from the jets uniformly distributes burning fuel about the annulus to thereby enable the use of fewer fuel injectors while avoiding the presence of hot spots or cold spots. Moreover, because the number of fuel injectors for a given turbine is minimized, the fuel flow path in each injector may be increased in size to thereby reduce the possibility of clogging.

According to a preferred embodiment, the jets are in fluid communication with the diffuser to receive compressed air therefrom.

In a highly preferred embodiment, the fuel injectors comprise fuel nozzles having ends within the primary combustion annulus and air atomizing nozzles for the combustion supporting air surround each of the ends of the fuel injector fuel nozzles.

The invention contemplates the use of a compressed air housing surrounding the combustor in spaced relation thereto and in fluid communication with the diffuser. The jets open to the interface of the housing and combustor to receive compressed air therefrom.

In a highly preferred embodiment, the combustor has an inner wall and and outer wall and the injectors are located on the outer wall and oriented to generally inject on a direction tangential to the inner wall.

Other objects and advantages will become apparent from the following specification taken in connection with the accompanying drawings.

DESCRIPTION OF THE PREFERRED EMBODIMENT

Figure 1:
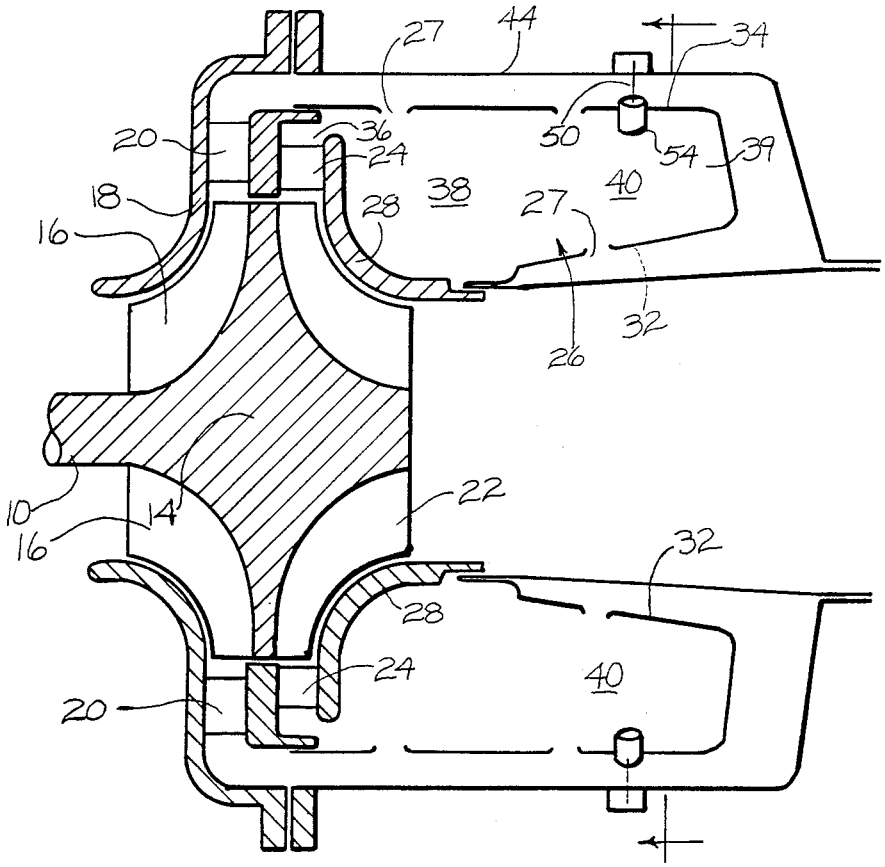
FIG. 1 is a somewhat schematic, sectional view of a turbine made according to the invention.

An exemplary embodiment of a gas turbine made according to the invention is illustrated in the drawings in the form of a radial flow gas turbine. However, the invention is not so limited, having applicability to any form of turbine or other fuel combusting device requiring an annular combustor.

The turbine includes a rotary shaft 10 journalled by bearings not shown. Adjacent one end of the shaft 10 is an inlet area 12. The shaft 10 mounts a rotor, generally designated 14 which may be of conventional construction. Accordingly, the same includes a plurality of compressor blades 16 adjacent the inlet 12. A compressor blade shroud 18 is provided in adjacency thereto and just radially outwardly of the radially outer extremities of the compressor blades 18 is a conventional diffuser 20.

Oppositely of the compressor blades 16, the rotor 14 has a plurality of turbine blades 22. Just radially outwardly of the turbine blades 22 is an annular nozzle 24 which is adapted to receive hot gasses of combustion from a combustor, generally designated 26. The compressor system including the blades 16, shroud 18 and diffuser 20 delivers hot air to the combustor 26, and via dilution air passages 27, to the nozzle 24 along with the gasses of combustion. That is to say, hot gasses of combustion from the combustor 26, are directed via the nozzle 24 against the blades 22 to cause rotation of the rotor 14 and thus the shaft 10. The latter may be, of course, coupled to some sort of apparatus requiring the performance of useful work.

A turbine blade shroud 28 is interfitted with the combustor 26 to close off the flow path from the nozzle 24 and confine the expanding gas to the area of the turbine blades 22.

The combustor 26 has a generally cylindrical inner wall 32 and a generally cylindrical outer wall 34. The two are concentric and merge to a necked down area 36 which serves as an outlet from the interior annulus 38 of the combustor to the nozzle 24. A third wall 39, generally concentric with the walls 32 and 34, interconnects the same to further define the annulus 38.

Oppositely of the outlet 36, and adjacent the wall 39, the interior annulus 38 of the combustor 26 includes a primary combustion zone 40. By primary combustion zone, it is meant that this is the area in which the burning of fuel primarily occurs. Other combustion may, in some instances, occur downstream from the primary combustion area 40 in the direction of the outlet 36. As mentioned earlier, provision is made for the injection of dilution air through the passageways 27 into the combustor 26 downstream of the primary combustion zone 40 to cool the gasses of combustion to a temperature suitable for application to the turbine blades 22 via the nozzle 24.

In any event, it will be seen that the primary combustion zone 40 is an annulus or annular space defined by the generally radially inner wall 32, the generally radially outer wall 34 and the wall 39.

A further wall 44 is generally concentric to the walls 32 and 34 and is located radially outwardly of the latter. The wall 44 extends to the outlet of the diffuser 20 and thus serves to contain and direct compressed air from the compressor system to the combustor 26.

Figure 2:
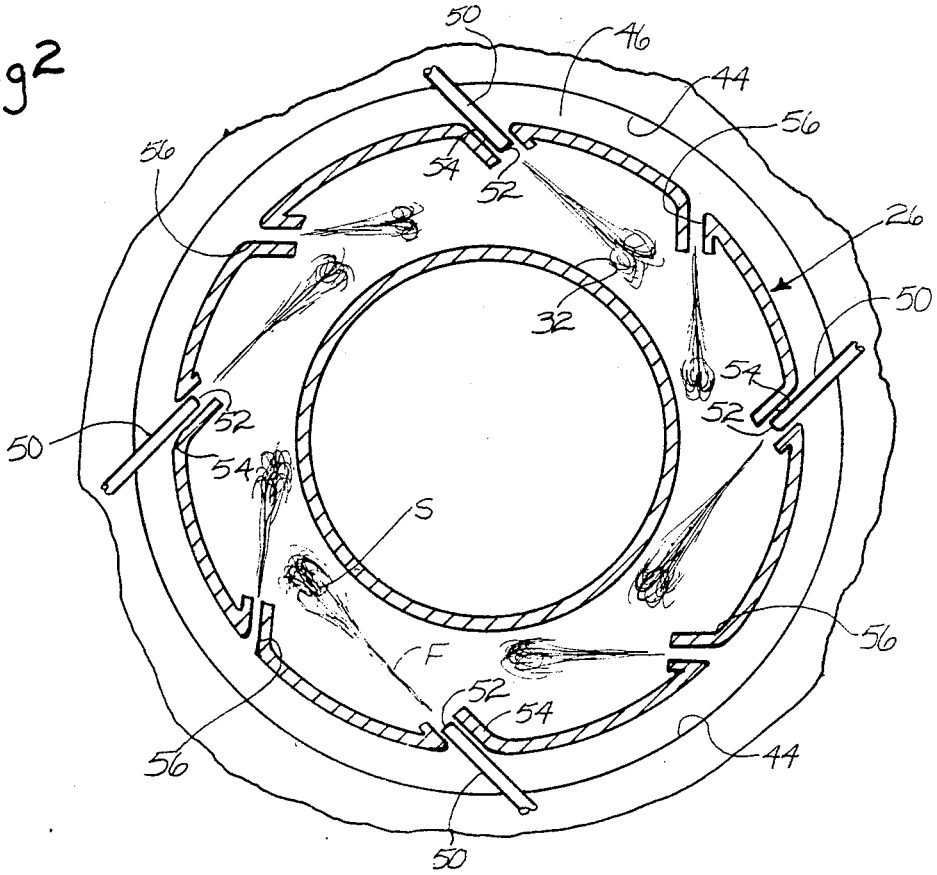
FIG. 2 is a sectional view taken approximately along the line 2—2 in FIG. 1.
Figure 3:
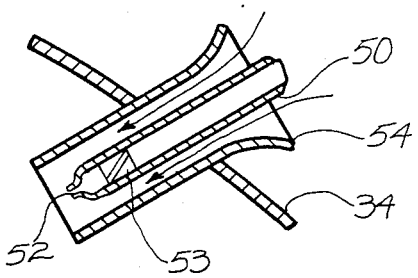
FIG. 3 is a fragmentary, sectional view of a conventional form of fuel injection nozzle that may be utilized in the invention.

As best seen in FIG. 2, the combustor 26 is provided with a plurality of conventional fuel injection nozzles 50, one of which is illustrated in FIG. 3. The fuel injection nozzles 50 have ends 52 disposed within the primary combustion zone 40 and which are configured to be nominally tangential to the inner wall 32. The fuel injection nozzles 50 conventionally utilize the pressure drop of fuel across swirl generating orifices 53 to accomplish fuel atomization. Tubes 54 surround the nozzles 50. High velocity air from the compressor flows through the tubes 54 to enhance fuel atomization. Thus the tubes 54 serve as air injection tubes.

The fuel injecting nozzles 50 are equally angularly spaced about the primary combustion annulus 40 and disposed between each pair of adjacent nozzles 50 is a combustion supporting air jet 56. The jets 56 are located on the wall 34 and establish fluid communication between the air delivery annulus defined by the walls 34 and 44 and the primary combustion annulus 40. These jets 56 may be somewhat colloquially termed "bender" jets as will appear. They are also oriented so that the combustion supporting air entering through them enters the primary combustion annulus 40 in a direction nominally tangential to the inner wall 32.

Preferably the injectors 50 and jets 56 are coplanar or in relatively closely spaced planes remote from the outlet area 36. Such plane or planes are transverse to the axis of the shaft 10.

Figure 4:
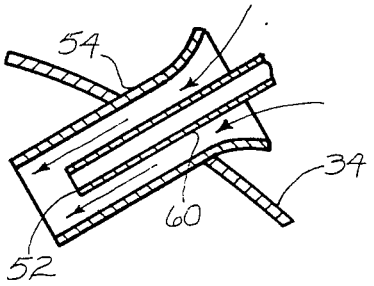
FIG. 4 is a view similar to FIG. 3 but of a modified form of fuel injection nozzle.

As an alternative to the conventional nozzles 50 shown in FIG. 3, the same may be replaced with simple tubes 60 as seen in FIG. 4. In such a case, the high velocity of the air flowing through the air injection tubes 54 provides the required fuel atomization as well as a desirable and necessary tangential mix of fuel and air.

Figure 5:
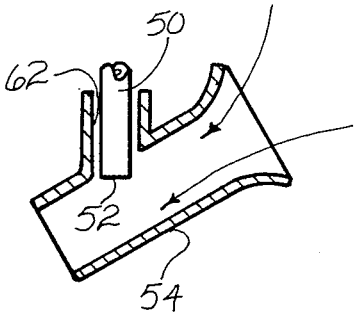
FIG. 5 is a view similar to FIGS. 3 and 4 but of a further modified fuel injection nozzle.

It should be further noted that the location of the fuel nozzles 50 or tubes 60 is not critical and differing arrangements from those described can be utilized. For example, each air injection tube 54 might be provided with a port 62 in one side thereof for receipt of the nozzle 50 or a tube 60. This form of the invention is illustrated in FIG. 5.

Operation is generally as follows. Fuel emanating from each of the nozzles 50 will enter along a line such as shown at "F" in connection with the lowermost nozzle 50 in FIG. 2. This line will of course be straight and it will be expected that the fuel will diverge from it somewhat. As the fuel approaches the adjacent bender jet 56 in the clockwise direction, the incoming air from the diffuser 20 and compressor blades 16 will tend to deflect or bend the fuel stream to a location more centrally of the primary combustion annulus 40 as indicated by the curved line "S". There will, of course, be a substantial generation of turbulence at this time and such turbulence will promote uniformity of burn within the primary combustion annulus 40 and this in turn will result in a uniform circumferential turbine inlet temperature distribution at the nozzle 24 and at radially outer ends of the turbine blades 22. Such uniform turbine inlet temperature distribution is achieved in a combustor made according to the invention utilizing approximately half the number of fuel injecting nozzles 50 that would be required according to prior art teachings. In other words, each bender jet 56, which may be of relatively inexpensive construction, has the ability to replace one, much more extensive fuel injector nozzle 50. Thus, a substantial cost savings results.

Moreover, where the number of fuel injections nozzles 50 is halved using the principals of the invention, the fuel flow passages of the remaining fuel injection nozzles, assuming they are cylindrical, can be increased in diameter slightly over 40%. This increase in diameter reduces the possibility of plugging of the fuel injectors nozzles 50 to provide a more trouble free apparatus.

I claim:

1. A gas turbine comprising:

a rotor including compressor blades and turbine blades;

an inlet adjacent one side of said compressor blades;

a diffuser adjacent the other side of said compressor blades;

a nozzle adjacent said turbine blades for directing hot gasses at said turbine blades to cause rotation of said rotor; and an annular combustor about said rotor and having an outlet connected to said nozzle and a primary combustion annulus remote from said outlet, a plurality of fuel injectors to said primary combustion annulus and being substantially equally angular spaced therearound and configured to inject fuel into said primary combustion annulus in a nominally tangential direction and at least an equal number of combustion supporting gas jets located about said primary combustion annulus in alternating relation with said fuel injectors, said jets being configured to introduce a combustion supporting gas into said primary combustion annulus in a nominally tangential direction, combustion supporting gas from said jets uniformly distributing burning fuel about said annulus to thereby enable the use of fewer fuel injectors while avoiding the presence of hot spots.

2. The gas turbine of claim 1 wherein said jets are in fluid communication with said diffuser to receive compressed gas therefrom.

3. The gas turbine of claim 1 wherein said fuel injectors comprise fuel nozzles having ends within said primary combustion annulus, and atomizing nozzles for said combustion supporting gas surrounding said ends.

4. The gas turbine of claim 1 wherein a compressed gas housing surrounds said combustor in spaced relation thereto and is in fluid communication with said diffuser, said jets opening to the interface of said housing and combustor to receive compressed gas therefrom.

5. The gas turbine of claim 1 wherein said jets are mounted in said second wall.

6. A gas turbine comprising a rotor including compressor blades and turbine blades;

an inlet adjacent one side of said compressor blades;

a diffuser adjacent the other side of said compressor blades;

a nozzle adjacent said turbine blades for directing hot gasses at said turbine blades to cause rotation of said rotor; and an annular combustor about said rotor and having an outlet to said nozzle, an inner wall and an outer wall spaced therefrom, a plurality of fuel injectors at substantially equally angularly spaced locations about said outer wall and oriented generally tangentially to said inner wall, and a plurality of combustion supporting gas jets in said outer wall and located in alternating fashion with said fuel injectors.

7. The gas turbine of claim 5 wherein said jets are also oriented generally tangentially to said inner wall.

8. The gas turbine of claim 6 wherein said nozzles and jets are coplanar or in relatively closely spaced planes and remote from said outlet.

9. A gas turbine comprising a rotor including compressor blades and turbine blades;

an inlet adjacent one side of said compressor blades;

a diffuser adjacent the other side of said compressor blades;

a nozzle adjacent said turbine blades for directing hot gasses at said turbine blades to cause rotation of said rotor; and an annular combustor about said rotor and having first, second and third, generally concentric, spaced walls centered about said rotor, said first wall being radially inwardly of said second and third walls and said second wall being radially inwardly of said third wall, said first and second walls defining an annular combustor or combustion space having an outlet to said nozzle and said second and third walls defining an annular manifold for receiving compressed gas from said diffuser for combustion or for combustion and dilution and for cooling said second wall, a plurality of fuel injection nozzles ror injecting fuel at spaced locations into said space in a non radial generally non axial direction and a similar number of combustion supporting gas jets communicating between said space and said manifold and located between said injectors in alternating fashion therewith, said jets introducing gas into said space in a non radial, generally non axial direction.

* * * * *